US010048011B2

(12) United States Patent
Lee et al.

(10) Patent No.: US 10,048,011 B2
(45) Date of Patent: Aug. 14, 2018

(54) HEAT EXCHANGER

(71) Applicant: LG ELECTRONICS INC., Seoul (KR)

(72) Inventors: Changuk Lee, Seoul (KR); Sujin Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/276,909

(22) Filed: Sep. 27, 2016

(65) Prior Publication Data

US 2017/0160016 A1 Jun. 8, 2017

(30) Foreign Application Priority Data

Dec. 8, 2015 (KR) ..... 10-2015-0173921

(51) Int. Cl.
*F28F 9/02* (2006.01)
*F28D 7/00* (2006.01)
(Continued)

(52) U.S. Cl.
CPC ..... *F28D 7/0066* (2013.01); *F28D 1/05375* (2013.01); *F28D 1/05391* (2013.01);
(Continued)

(58) Field of Classification Search
CPC ..... F28F 2250/06; F28F 9/02–9/0212; F28F 27/02; F28F 7/0066; F28F 1/05383; F28F 1/05391
(Continued)

(56) References Cited

U.S. PATENT DOCUMENTS 2,539,669 A * 1/1951 Newcomer ..... F01P 7/14 165/283
3,534,815 A * 10/1970 Kagi ..... F22B 37/72 122/406.3
(Continued)

FOREIGN PATENT DOCUMENTS

EP 0 855 567 7/1998
EP 0 887 611 12/1998
(Continued)

OTHER PUBLICATIONS

European Search Report dated Apr. 28, 2017 issued in Application No. 16193042.5.

*Primary Examiner* — Jason Thompson
(74) *Attorney, Agent, or Firm* — Ked & Associates LLP

(57) ABSTRACT

A heat exchanger is provided which can reduce a pressure drop of a refrigerant by replacing a portion or all of baffles of a related art heat exchanger with guides having a specific configuration. The heat exchanger may include a plurality of tubes in which a refrigerant may flow; a plurality of heat dissipation fins into which the plurality of tubes may be inserted, the plurality of heat dissipation fins allowing heat exchange between the refrigerant and a fluid; at least one header coupled to at least one side of the plurality of tubes, the at least one header forming a flow space for the refrigerant; and at least one guide provided inside of the at least one header to partition the flow space and to guide the refrigerant from the at least one header to the plurality of tubes. The at least one guide may include a support provided inside of the at least one header, the support having an opening formed therein, and a movable part movably provided to open and close the opening. The movable part may be movable by a liquid refrigerant in the refrigerant.

17 Claims, 8 Drawing Sheets

(51) Int. Cl.
*F28F 27/02* (2006.01)
*F28D 1/053* (2006.01)

(52) U.S. Cl.
CPC ..... *F28F 9/02* (2013.01); *F28F 9/0204* (2013.01); *F28F 9/028* (2013.01); *F28F 9/0209* (2013.01); *F28F 27/02* (2013.01)

(58) Field of Classification Search
USPC ..... 165/174, 282, 281
See application file for complete search history.

(56) References Cited

U.S. PATENT DOCUMENTS 3,877,514 A * 4/1975 Beck ..... F28F 27/02
137/493
4,230,174 A * 10/1980 Eubank ..... F24F 13/10
137/112
4,972,683 A * 11/1990 Beatenbough ..... F25B 39/04
165/110
5,141,048 A * 8/1992 Sausner ..... F28B 1/06
165/110
5,305,826 A * 4/1994 Couetoux ..... F01P 7/16
123/41.08
6,026,804 A 2/2000 Schardt et al.

FOREIGN PATENT DOCUMENTS

FR 2 910 608 6/2008
JP H03 247993 11/1991
KR 10-2000-0061954 5/2002
WO WO 2013/162222 10/2013
WO WO 2013162222 A1 * 10/2013 ..... F25B 39/00

* cited by examiner

HEAT EXCHANGER

CROSS-REFERENCE TO RELATED APPLICATION(S)

The present application claims priority under 35 U.S.C. 119 and 35 U.S.C. 365 to Korean Patent Application No. 10-2015-0173921, filed in Korea on Dec. 8, 2015, which is hereby incorporated by reference in its entirety.

BACKGROUND

1. Field

A heat exchanger is disclosed herein.

2. Background

In general, air conditioners are apparatuses that maintain air in a predetermined space in a most suitable state according to their use and purpose. More particularly, an internal refrigerant undergoes a phase change while passing through a compressor, a condenser, an expander, and an evaporator. In this case, an apparatus used as the condenser or the evaporator is a heat exchanger.

In general, a heat exchanger is one component constituting a heat exchange cycle. As heat exchange is performed between a refrigerant flowing in the heat exchanger and an external fluid, the heat exchanger functions to condense or evaporate the refrigerant.

Such heat exchangers are classified into fin-and-tube type heat exchangers and micro-channel type heat exchangers, according to shapes thereof. A fin-and-tube type heat exchanger may include a plurality of fins and a cylindrical or cylindrical-like tube passing through the plurality of fins. A micro-channel type heat exchanger may include a plurality of flat tubes in which a refrigerant flows and fins provided between the plurality of flat tubes. Both of the fin-and-tube type heat exchanger and the micro-channel type heat exchanger exchange heat between an external fluid and a refrigerant flowing in the tube or the flat tubes, and the plurality of fins increase a heat exchange area between the external fluid and the refrigerant flowing in the tube or the flat tubes, thereby improving a heat exchange efficiency of the refrigerant.

Such a heat exchanger may be used for an air conditioner as one component of a refrigerating cycle. According to an operation mode of the air conditioner, the heat exchanger may serve as a condenser that condenses a refrigerant or an evaporator that evaporates the refrigerant. For example, the heat exchanger may serve as the condenser in a cooling operation of the air conditioner and as the evaporator in a heating operation of the air conditioner.

FIG. 1 is a cross-sectional view of a related art heat exchanger. Referring to FIG. 1, the heat exchanger 1 may include a plurality of flat tubes 4, a plurality of headers 2, 3 coupled to the plurality of flat tubes 4, and a plurality of heat dissipation fins 5 connected to the plurality of flat tubes 4.

A flow path through which a refrigerant flows is formed inside of the plurality of flat tubes 4, and one end of each of the plurality of flat tubes 4 may be coupled to a first header 2 among the plurality of headers 2, 3. The other end of each of the plurality of flat tubes 4 may be coupled to a second header 3 among the plurality of headers 2, 3.

The first header 2 may include a refrigerant inlet part or inlet 6 that provides a flow path through which a refrigerant is introduced such that the refrigerant may be introduced into the heat exchanger 1, and a refrigerant outlet part or outlet 7 through which a refrigerant heat-exchanged in the heat exchanger 1 may be discharged to the outside. In addition, a plurality of baffles 8 that guides a flow of a refrigerant are provided inside of the first header 2 and the third header 3. The plurality of baffles 8 is disposed to be fixed to an inside of the first header 2 and the second header 3, and a flow direction of a refrigerant inside of the first header 2 or the second header 3 is changed by the plurality of baffles 8. Accordingly, the refrigerant can flow into the plurality of flat tubes 4.

While a refrigerant introduced into the heat exchanger 1 is in a two-phase state in which a liquid refrigerant and a gaseous refrigerant are mixed, a refrigerant just before being discharged from the heat exchanger 1 may be a gaseous refrigerant or a two-phase-state refrigerant having a very high degree of dryness. That is, the refrigerant flowing in the plurality of flat tubes 4 may be a two-phase-state refrigerant in which a liquid refrigerant and a gaseous refrigerant are mixed at a predetermined ratio.

A related art heat exchanger is disclosed in Korean Patent Application No. 10-2000-0061954, published on May 2, 2002 and entitled "Condenser for Air Conditioner", which is hereby incorporated by reference. However, the related art heat exchanger has the following problems.

There is a problem in that, when a two-phase-state refrigerant flows in the flat tube, frictional resistance caused by the two-phase-state refrigerant occurs in the flat tube, and noise occurs due to friction between the refrigerant and the flat tube, more particularly, friction between a liquid refrigerant and the flat tube. In addition, there is a problem in that a pressure loss of the refrigerant occurs due to frictional resistance between the flat tube and the refrigerant.

Further, there is a problem in that, when the pressure loss occurs in the refrigerant, a heat exchange efficiency of the heat exchanger is degraded, and therefore, an entire refrigeration efficiency of the air conditioner is lowered. Furthermore, there is a problem in that, as the liquid refrigerant in the two-phase state refrigerant is heat-exchanged while passing through the flat tube even though the heat exchange of the liquid refrigerant is not necessary because the liquid refrigerant has already been condensed, the heat exchange efficiency of the heat exchanger is degraded. More particularly, when a plurality of heat exchange tubes is arranged in a top-bottom or vertical direction, the liquid refrigerant flows in a lower heat exchange tube and a gaseous refrigerant flows in an upper heat exchange tube due to a difference in specific gravity between the liquid refrigerant and the gaseous refrigerant. In this case, there is a problem in that a heat exchange performance through the lower heat exchange tube is deteriorated.

BRIEF DESCRIPTION OF THE DRAWINGS

Embodiments will be described in detail with reference to the following drawings in which like reference numerals refer to like elements, and wherein.

DETAILED DESCRIPTION

Figure 1:
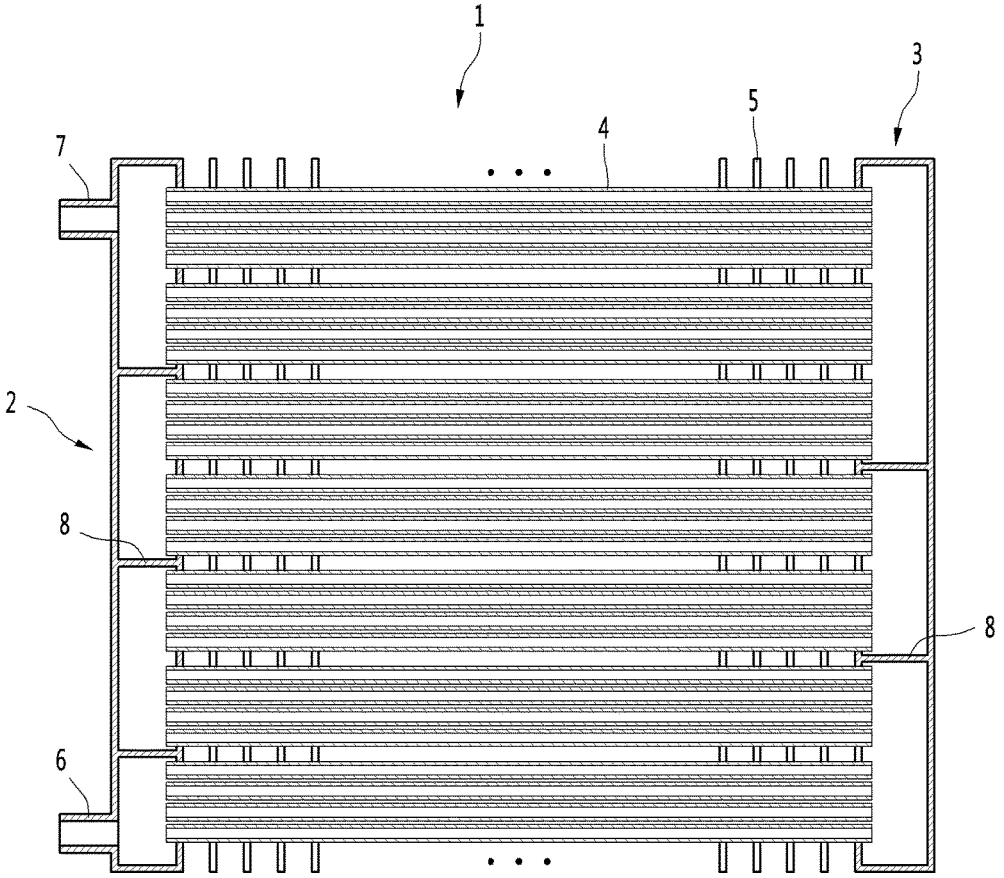
FIG. 1 Related Art
FIG. 1 is a cross-sectional view of a related art heat exchanger.

Reference will now be made in detail to embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art to practice the embodiments, the description may omit certain information known to those skilled in the art. The following detailed description is, therefore, not to be taken in a limiting sense.

Also, in the description of embodiments, terms such as first, second, A, B, (a), (b) or the like may be used herein when describing components. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
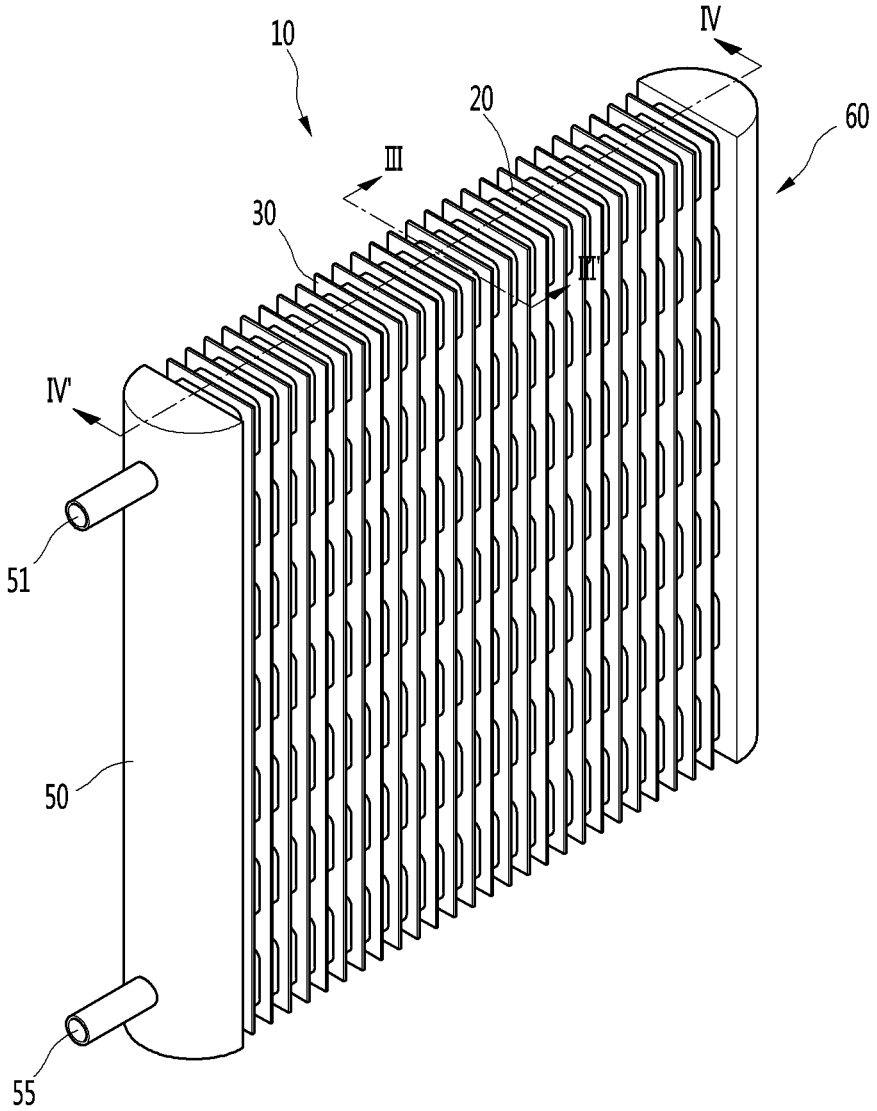
FIG. 2 is a perspective view of a heat exchanger according to an embodiment.
Figure 3:
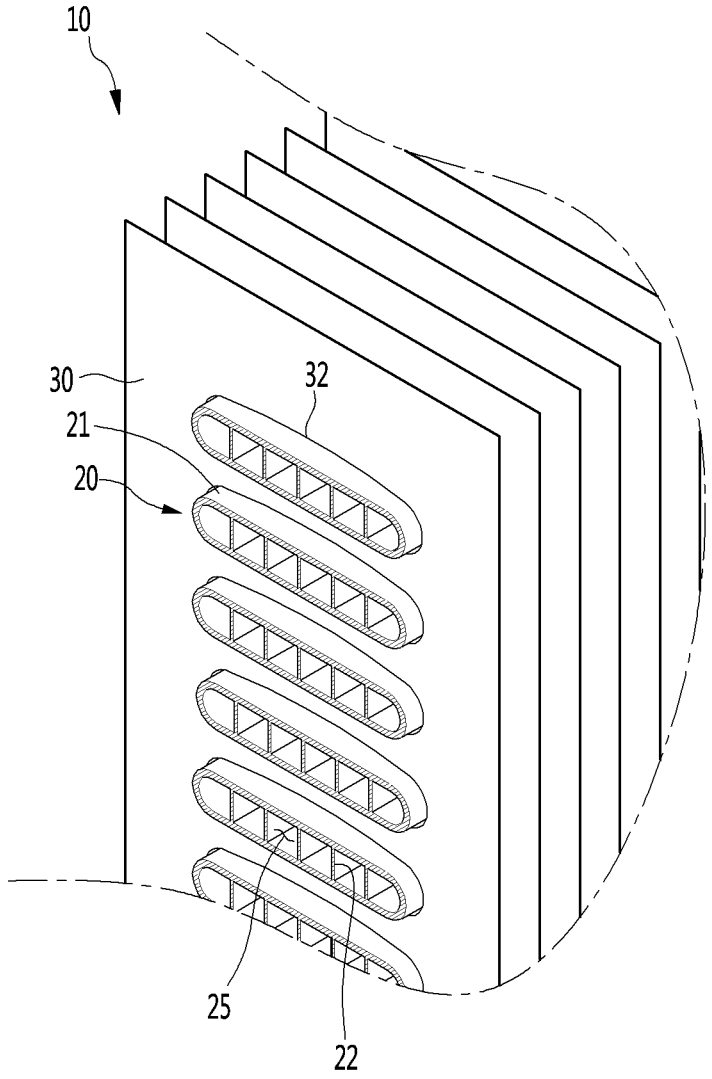
FIG. 3 is a cross-sectional view taken along line III-III' of FIG. 2.
Figure 4:
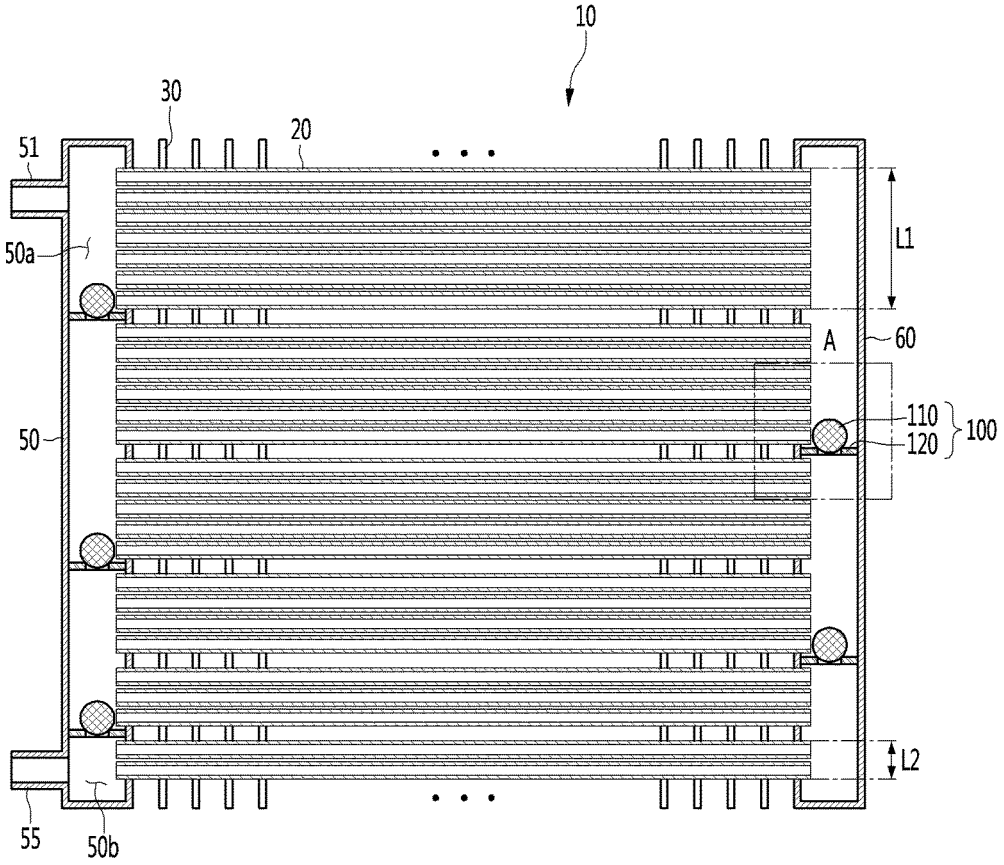
FIG. 4 is a cross-sectional view taken along line IV-IV' of FIG. 2.
Figure 5:
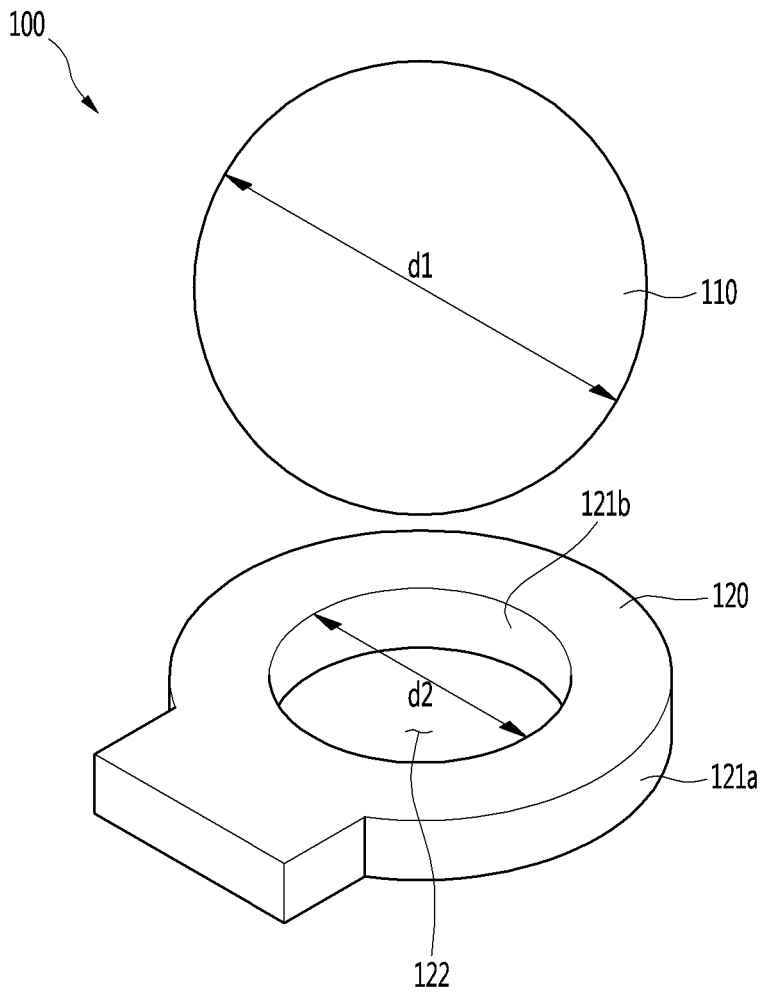
FIG. 5 is an exploded view of a guide of the heat exchanger of FIG. 2 according to an embodiment.
Figure 6:
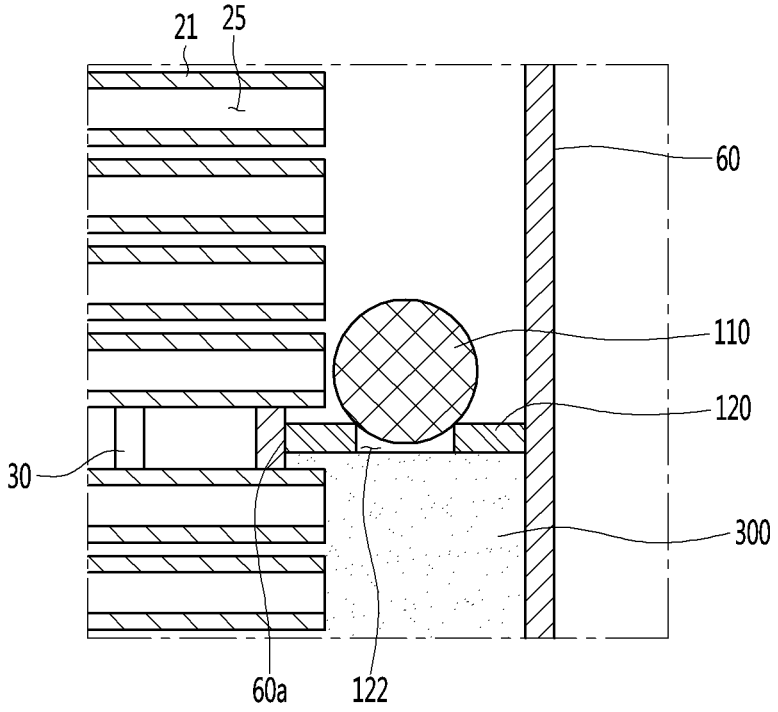
FIG. 6 is an enlarged view of portion A of FIG. 4.
Figure 7:
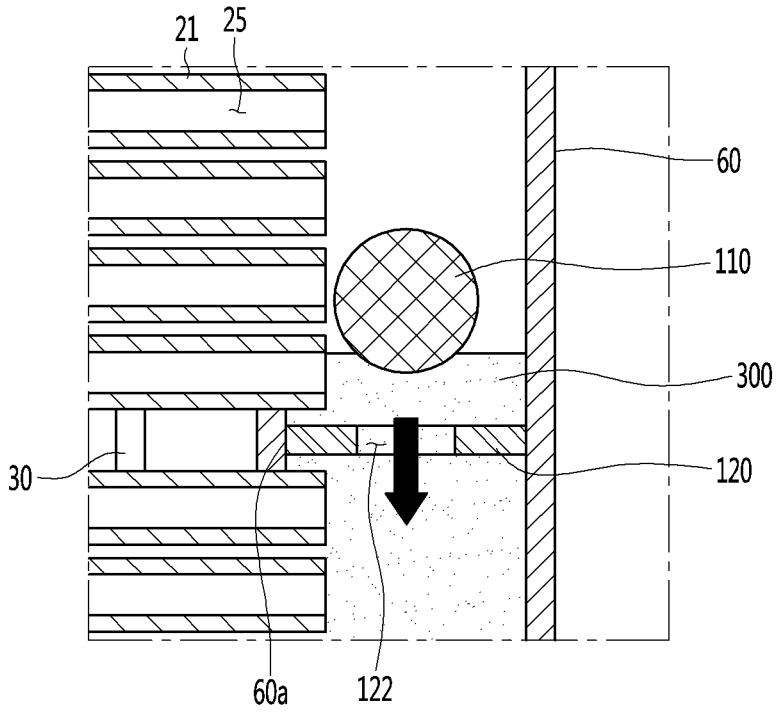
FIG. 7 is a view showing an operation of the guide of the heat exchanger according to an embodiment.
Figure 8:
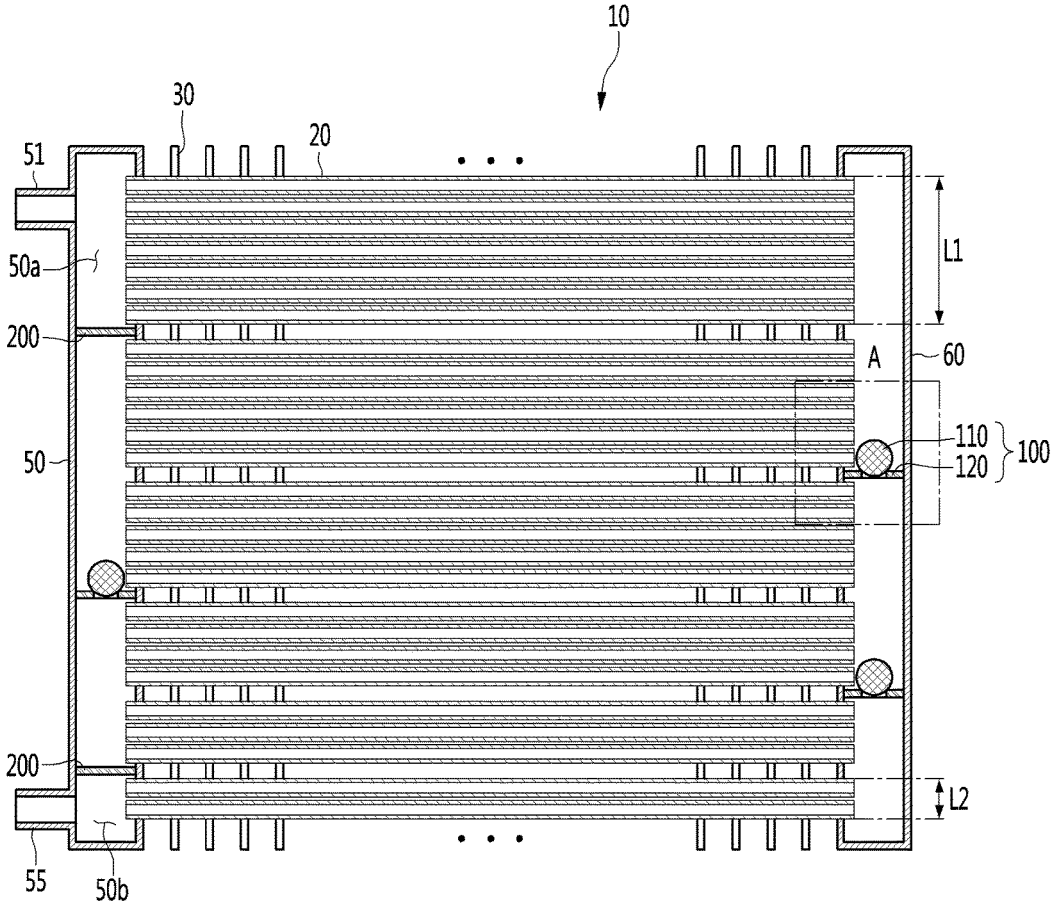
FIG. 8 is a front cross-sectional view of a heat exchanger in which baffles are formed at a header of the heat exchanger according to an embodiment.

FIG. 2 is a perspective view of a heat exchanger according to an embodiment. FIG. 3 is a cross-sectional view taken along line III-III' of FIG. 2. FIG. 4 is a cross-sectional view taken along line IV-IV' of FIG. 2. FIG. 5 is an exploded view of a guide of the heat exchanger of FIG. 2 according to an embodiment. FIG. 6 is an enlarged view of portion A of FIG. 4. FIG. 7 is a view showing an operation of the guide of the heat exchanger of FIG. 2 according to an embodiment. FIG. 8 is a front cross-sectional view of a heat exchanger in which baffles are formed at a header of the heat exchanger according to an embodiment.

Referring to FIGS. 2 to 4, the heat exchanger 10 according to an embodiment may include a header 50 and 60, a plurality of tubes 20, and a plurality of heat dissipation fins 30. The header 50 and 60 may extend by a predetermined length in a top-bottom or vertical direction, and may be coupled to both ends of the plurality of tubes 20, thereby fixing the plurality of tubes 20.

The header 50 and 60 may include a first header 50 coupled to one or first ends of the plurality of tubes 20 and a second header 60 coupled to the other or second ends of the plurality of tubes 20. A first inlet/outlet part or inlet/outlet 51 and a second inlet/outlet part or inlet/outlet 55, which allow a refrigerant to be introduced into the heat exchanger 10 and to be discharged from the heat exchanger 10, respectively, may be formed at the first header 50 and the second header 60. For example, the first inlet/outlet 51 and/or the second inlet/outlet 55 may be formed at or in the first header 50.

The first inlet/outlet 51 may be connected to an upper side of the first header 50, and the second inlet/outlet 55 may be connected to a lower side of the first header 50. For example, when the heat exchanger 10 serves as a condenser, a refrigerant may be introduced through the first inlet/outlet 51, condensed while flowing in a direction of gravity through the plurality of tubes 20, and then be discharged through the second inlet/outlet 55. That is, the refrigerant may flow downwardly toward the second inlet/outlet 55 from the first inlet/outlet 51.

On the other hand, when the heat exchanger 10 serves as an evaporator, a refrigerator may be introduced through the second inlet/outlet 55, evaporated while flowing in an opposite direction of gravity through the plurality of tubes 20, and then discharged through the first inlet/outlet 51. That is, the refrigerant may flow upwardly toward the first inlet/outlet 51 from the second inlet/outlet 55.

The plurality of tubes 20 may have a shape extending by a predetermined length in a lateral or horizontal direction, to be coupled to the first header 50 and the second header 60, and a flow path through which a refrigerant may flow may be formed inside of the plurality of tubes 20. The plurality of tubes 20 may be spaced apart from each other by a predetermined distance in an extending direction of the first header 50 and the second header 60, that is, in the top-bottom or vertical direction between the first header 50 and the second header 60. Accordingly, the refrigerant may flow through the flow path formed inside of the plurality of tubes 20 and then be discharged through the first inlet/outlet 51 or the second inlet/outlet 55 via the first header 50 and the second header 60.

In addition, each of the plurality of tubes 20 may include a tube body 21 forming an external appearance thereof and at least one partition rib 22 allowing a plurality of refrigerant flow paths 25 to be formed inside of the tube body 21. The refrigerant introduced into the plurality of tubes 20 may flow to be uniformly distributed to the plurality of refrigerant flow paths 25. In addition, through-holes 32 may be formed in the plurality of heat dissipation fins 30 such that the plurality of tubes 20 may be coupled thereto by passing therethrough.

In addition, a flow space of the refrigerant may be defined by internal structures of the first header 50 and the second header 60. A refrigerant inside of the first header 50 or the second header 60 may be introduced into the plurality of tubes 20, and a direction of a refrigerant flowing through the flow path inside of the plurality of tubes 20 may be changed in the first header 50 or the second header 60.

For example, the direction of a refrigerant introduced through the first inlet/outlet 51 and then flowing in a first lateral direction (to the right in the drawings) through the plurality of tubes 20 may be changed in the second header 60 such that the refrigerant flows in a second lateral direction (to the left in the drawings) through the plurality of tubes 20. The direction of the refrigerant introduced in the second lateral direction may be changed in the first header 50 such that the refrigerant again flows in the first lateral direction. As the refrigerant flows in a state in which the direction of the refrigerant is changed in the first/second lateral direction along the first header 50 and the second header 60, the first header 50 or the second header 60 may be referred to as a "return header."

Referring to FIG. 8, one or more baffle 200 and one or more guide part or guide 100 may be disposed or provided inside of the first header 50 and the second header 60. The baffle 200 may guide the flow of the refrigerant, and the guide 100 may guide the flow of the refrigerant and simultaneously enable a portion of the refrigerant to be discharged directly downwardly without passing through the plurality of tubes 20 according to a degree of super-cooling of the refrigerant. That is, a change in flow direction of the refrigerant may be formed by the baffle 200 and the guide 100.

The baffle 200 may be disposed or provided inside of the header 50 and the second header 60, to guide a refrigerant introduced into the first header 50 and the second header 60 to flow in the plurality of tubes 20. For example, the baffle 200 may be disposed or provided inside of the first header 50 so as to form an upper space 50*a* in the first header 50 to which the first inlet/outlet 51 may be connected. That is, the baffle 200 may shield or block, by a length of L1, the inside of the first header 50 to which the first inlet/outlet 51 may be connected, so that a refrigerant in an internal space of the first header 50, which corresponds to the length of L1, may be sent to a plurality of tubes 20 connected to an internal space of the first header 50 or so that a refrigerant may be received from the plurality of tubes 20 connected to the internal space of the first header 50, which corresponds to the length of L1.

In addition, the baffle 200 may be provided inside of the first header 50 so as to form a lower space 50*b* of the first header 50 to which the second inlet/outlet 55 may be connected. That is, the baffle 200 may shield or block, by a length of L2, the inside of the first header 50 to which the second inlet/outlet 55 is connected, so that a refrigerant in an internal space of the first header 50, which corresponds to the length of L2, may be sent to a plurality of tubes 20 connected to the internal space of the first header 50 or so that a refrigerant may be received from the plurality of tubes 20 connected to the internal space of the first header 50, which corresponds to the length of L2.

The guide 100 may be provided inside of the header 50 and 60, to guide the flow of a refrigerant and simultaneously enable a liquid refrigerant to be discharged directly downwardly without passing through the plurality of tubes 20 according to the degree of super-cooling of the refrigerant. That is, one or more guides 100 may be provided, and the guides 100 may be provided to be spaced apart from each other in a lengthwise direction of the first header 50 and the second header 60.

In addition, the internal space of the first header 50 may be partitioned into a plurality of flow spaces by the one or more baffle 200 and the one or more guide 100, and the internal space of the second header 60 may be partitioned into a plurality of flow spaces by the one or more guide 100. The guide 100 may be provided inside of the first header 50 and the second header 60. In this case, a refrigerant may flow into the plurality of tubes 20 and the second header 60 from the first header 50 by the flow spaces defined by the one or more baffle 200 and the one or more guide 100. In addition, the refrigerant flowing into the second header 60 may flow into the plurality of tubes 20 and the first header 50 by the flow spaces defined by the one or more guide 100. That is, the flow path of the refrigerant flowing along the plurality of tubes 20 may from an S-shaped meander line due to the one or more baffle 200 and the one or more guide 100. As the flow path of the refrigerant flowing along the plurality of tubes 20 forms the meander line, a heat exchange time of the refrigerant may be increased, thereby improving a heat exchange efficiency of the refrigerant.

Accordingly, hereinafter, a configuration in which a first baffle 200, a first guide 100, and a second baffle 200 are sequentially provided inside of the first header 50, and a plurality of guides 100 spaced apart from each other in the lengthwise direction of the second header 60 are provided inside of the second header 60 will be described as an example. However, such a configuration is merely an example of the heat exchanger 10 according to an embodiment, and the baffle 200 may be replaced with the guide 100 as shown in FIG. 4. In this case, in the heat exchanger 10, a plurality of first guides 100 may be provided inside of the first header 50, and a plurality of second guides 100 may be provided inside of the second header 60.

In addition, the other components may be the same except for positions at which the first baffle 200 and the second baffle 200 are provided, and the other components in the same except positions at which the first guide 100 and the second guide 100 are provided. Hence, like reference numerals are designated to refer to like components, and repetitive disclosure has been omitted.

When the heat exchanger 10 serves as the condenser, a refrigerator may be introduced through the first inlet/outlet 51, to move along the flow path of a meander line while flowing in the first lateral direction (to the right in the drawing) along a plurality of tubes 20 connected to a space of the first header 50, formed by the first baffle 200, flowing in the second lateral direction (to the left in the drawing) along a plurality of tubes 20 connected to a space of the second header 60, formed by the second guide 100, and then again flowing in the first lateral direction (to the right in the drawing) from a space of the first header 50, formed by the first guide 100. In addition, as the refrigerant moves as described above, heat exchange may be performed by the plurality of heat dissipation fins 30 inside of the plurality of tubes 20, so that the refrigerant may be condensed as a liquid refrigerant. The condensed liquid refrigerant may be discharged to the outside through the second inlet/outlet 55.

Although the heat exchanger 10 having flow paths with six directions has been disclosed in FIGS. 4 and 8, embodiments are not limited thereto, and a number of the flow paths may be changed. Therefore, a number of guides 100 may also be changed. In addition, approaching a lower portion from an upper portion of the heat exchanger 10, a number of tubes 20 through which the refrigerant may pass in one direction may be gradually decreased, or a flow volume of the tube 20 may be gradually decreased.

When the heat exchanger 10 serves as the condenser, the refrigerant introduced through first inlet/outlet 51 may be a gaseous refrigerant or a two-phase-state refrigerant having a high degree of dryness, and the refrigerant discharged through the second inlet/outlet 55 may be a liquid refrigerant or a two-phase-state refrigerant having a low degree of dryness. Therefore, in a process in which the refrigerant introduced through the first inlet/outlet 51 passes through the heat exchanger 10, a density of the refrigerant may be increased, and a specific volume of the refrigerant may be decreased.

In addition, when the heat exchanger 10 serves as the evaporator, a liquid refrigerant introduced through the second inlet/outlet 55 may be changed into a gaseous refrigerant in a process in which the liquid refrigerant passes through the heat exchanger 10. That is, in the process in which the refrigerant introduced through the second inlet/outlet 55 passes through the heat exchanger 10, the density of the refrigerant may be decreased, and the specific volume of the refrigerant may be increased. Therefore, the number of tubes 20 coupled to an upper portion of the first header 50 and the second header 60, through which a gaseous refrigerant having a high specific volume or a two-phase-state refrigerant having a high degree of dryness passes, may be greater than the number of tubes 20 coupled to a lower portion of the first header 50 and the second header 60, through which a liquid refrigerant having a low specific volume or a two-phase-state refrigerant having a low degree of dryness passes.

For example, as shown in FIGS. 4 and 8, the number of tubes 20 coupled to the upper space 50*a* of the first header 50, that is, the space corresponding to the length of L1 may be greater than the number of tubes 20 coupled to the lower space 50*b* of the first header 50, that is, the space corresponding to the length of L2. In addition, in a direction approaching the lower portion from the upper portion of the heat exchanger 10, the number of tubes 20 may be gradually decreased.

This is for the purpose of improving a heat exchange efficiency of the gaseous refrigerant by considering that an amount of liquid refrigerant is increased in the direction approaching the lower portion from the upper portion of the heat exchanger 10 because the gaseous refrigerant has a higher specific volume than the liquid refrigerant.

Hereinafter, a guide according to an embodiment will be described. FIG. 5 is an exploded view of the guide of the heat exchanger of FIG. 2 according to an embodiment.

Referring to FIG. 5, the guide 100 may include a support part or support 120 and a movable part 110. The movable part 110 may be movably mounted on the support 120 or spaced apart from the support 120. The movable part 110 may be moved by a buoyancy of the refrigerant. When the refrigerant flowing in the internal space of the first header 50 and the second header 60 is super-cooled to have the form of a liquid refrigerant, the movable part 110 may be floated by the liquid refrigerant to be spaced apart from the support 120.

In this case, the movable part 110 may be made of a material having a lower density than a density of the refrigerant. The movable part may be made of a material having a lower density than the liquid refrigerant. Accordingly, when the gaseous refrigerant flows in the internal space of the first header 50 and the second header 60, the movable part 120 may be mounted on the support 120. When the liquid refrigerant flows in the internal space of the first header 50 and the second header 60, the movable part 110 may be floated by the liquid refrigerant, to be spaced apart from the support 120. In addition, the movable part 110 may have a spherical shape. However, embodiments are not limited thereto, and the movable part 110 may have a cylindrical shape.

The support 120 may be disposed or provided inside of the first header 50 and the second header 60 to support the movable part 110. The support 120 may have an opening 122 formed therein, and a refrigerant may flow through the opening 122. The support 120 may include an inner circumferential surface 121*b* defining the opening 122 and an outer circumferential surface 121*a* that contacts an inner surface of the first header 50 and the second header 60.

The outer circumferential surface 121*a* may contact an inner surface 60*a* of the second header 60, to be coupled to an inside of the second header 60. The outer circumferential surface 121*a* of the support 120 may be formed in a shape corresponding to the inner surface of the first header 50 and the second header 60, to come in surface contact with the inner surface of the first header 50 and the second header 60. That is, when one inner surface of the first header 50 and the second header 60 has a circular shape and the other inner surface of the first header 50 and the second header 60 has a linear shape, one or a first side of the outer circumferential surface 121*a* of the support 120 may be formed in a circular shape, and the other or a second side of the outer circumferential surface 121*a* of the support 120 may be formed in a linear shape.

The opening 122 may be opened in the top-bottom or vertical direction in the support 120, to provide a flow path through which a liquid refrigerant existing inside of the first header 50 and the second header 60 may flow in the top-bottom or vertical direction. In addition, the movable part 110 may be mounted on or in the opening 122. In this case, the opening 122 may be shielded or blocked by the movable part 110. That is, a portion of the outer surface of the movable part 110 may be formed in a shape configured to be inserted into the opening 122 to open/close the opening 122 and to control a flow of a refrigerant flowing through the opening 122. Such an operation will be described hereinafter.

For example, the movable part 110 may be a ball. When the movable part 110 is formed in a spherical shape having a diameter of d1, the opening 122 formed in the support 120 may be formed in a circular shape having a diameter of d2. In this case, the diameter of d1 may be greater than the diameter d2. That is, as the diameter of the movable part 110 is greater than the diameter of the opening 122, a portion of the movable part 110 may be placed in the opening 122. In this case, the opening 122 may be shielded or blocked by the movable part 110.

In addition, when the movable part 110 is formed in a cylindrical shape, a diameter of a cylinder may be greater than the diameter of the opening 122 formed in the support 120. Accordingly, the movable part 110 may be mounted on the support 120.

Hereinafter, an operation of the heat exchanger 10 according to an embodiment will be described. The first inlet/outlet 51 may be referred to as an inlet 51 and the second inlet/outlet 55 may be referred to as an outlet 55 in describing a case in which the heat exchanger 10 serves as the condenser.

When the heat exchanger 10 serves as the condenser, the heat exchanger 10 may allow a gaseous refrigerant compressed by a compressor to be introduced thereinto and then condensed, and may allow the condensed liquid refrigerant to be discharged therefrom. A refrigerant may be introduced into the heat exchanger 10 through the inlet 51. The refrigerant introduced into the heat exchanger 10 may be heat-exchanged with an external fluid by the plurality of heat dissipation fins 30 in a process in which the refrigerant passes through the plurality of tubes 20.

In the process in which the refrigerant is heat-exchanged, at least a portion of a gaseous refrigerant may be phase-changed into a liquid refrigerant, and therefore, the refrigerant may be in a two phase state in which the gaseous refrigerant and the liquid refrigerant are mixed during flowing of the refrigerant. In addition, as the flow path through which the refrigerant is circulated in the plurality of tubes 20 is lengthened, a ratio of the liquid refrigerant with respect to the refrigerant is increased, so that the refrigerant becomes a two-phase-state refrigerant having a low degree of dryness.

If a two-phase-state refrigerant passes through the plurality of tubes 20, the frictional resistance between the plurality of tubes 20 and the refrigerant is increased. Therefore, as a pressure drop of the refrigerant is increased, a heat conduction performance is deteriorated, and simultaneously, noise occurs. In addition, as the liquid refrigerant in the two-phase-state refrigerant in the plurality of tubes 20 is a refrigerant for which a condensation has already been completed, the refrigerant continuously flows in the plurality of tubes 20 even though the necessity of heat exchange is low. Accordingly, the heat exchanger 10 according to an embodiment separates the liquid refrigerant from the refrigerant flowing in the plurality of tubes 20 and allows the separated liquid refrigerant to be gathered at a lower portion of the first header 50, so that only the gaseous refrigerant may be heat-exchanged in the plurality of tubes 20.

When a two-phase-state refrigerant flows in the first header 50, the plurality of tubes 20, and the second header 60, the movable part 110 of the guide 100 may be floated by liquid refrigerant in the two-phase-state refrigerant. For example, a case in which a two-phase-state refrigerant passes through portion A of FIG. 4 will be described with reference to FIG. 7.

Referring to FIG. 7, when a two-phase-state refrigerant flows in the second header 60 by passing through the plurality of tubes 20, a liquid refrigerant 300 in the two-phase-state refrigerant may be moved downwardly by gravity. Accordingly, the liquid refrigerant 300 may be moved to the second guide 100.

If the liquid refrigerant 300 is moved to the second guide 100, the movable part 110 of the second guide 100 may be spaced apart from the support 120 while being floated upwardly by the liquid refrigerant 300. In this case, the opening 122 of the support 120 may be opened as the movable part 110 is spaced apart from the support 120, and the liquid refrigerant 300 may be moved downwardly by gravity through the opening 122. In addition, a gaseous refrigerant in the two-phase-state refrigerant is heat-exchanged by the plurality of heat dissipation fins 30 while flowing in the plurality of tubes 20. Accordingly, only the gaseous refrigerant in the two-phase-state refrigerant flows in the plurality of tubes 20, and the liquid refrigerant 300 may be moved to a lower portion of the second header 60 through the opening 122. That is, the liquid refrigerant 300 may be discharged to the outside through the outlet 55 in a state in which the liquid refrigerant 300 does not pass through the plurality of tubes 20 but is directly gathered at a lower end portion of the second header 60.

TABLE 1

| Speed of refrigerant | Refrigerant-side pressure drop value when related art baffle is applied (kPa) | Refrigerant-side pressure drop value when guide of embodiment is applied (kPa) | Relative error (%) | Effect (%) |
|---|---|---|---|---|
| 1.2 | 23.53 | 18.87 | 80 | 20 |
| 1.6 | 31.77 | 25.69 | 81 | 19 |
| 2.0 | 39.90 | 30.63 | 77 | 23 |

Table 1 shows a graph obtained by comparing refrigerant-side pressure drop values inside of the heat exchanger according to embodiments with refrigerant-side pressure drop values inside of the related art heat exchanger. Referring to Table 1, when the speed of a refrigerant is about 1.2 m/s, the refrigerant-side pressure drop value inside of the related art heat exchanger is about 23.53 kPa, and the refrigerant-side pressure drop value inside of the heat exchanger according to embodiments is about 18.87 kPa, which is lower by about 20% than that of the related art heat exchanger.

In addition, when the speed of the refrigerant is about 1.6 m/s, the refrigerant-side pressure drop value inside of the related art heat exchanger is about 31.77 kPa, and the refrigerant-side pressure drop value inside of the heat exchanger according to embodiments is about 25.69 kPa, which is lower by about 19% than that of the related art heat exchanger. When the speed of the refrigerant is about 2.0 m/s, the refrigerant-side pressure drop value inside the related art heat exchanger is about 39.90 kPa, and the refrigerant-side pressure drop value inside of the heat exchanger according to embodiments is about 30.63 kPa, which is lower by about 23% than that of the related art heat exchanger.

As the speed of the refrigerant is increased, the pressure drop value is increased. It can be seen that, in the heat exchanger according to embodiments, the pressure drop values are lowered by an average of about 20% in comparison with the related art heat exchanger.

That is, in the heat exchanger according to embodiments, as the liquid refrigerant flowing in the plurality of tubes is directly moved to the lower portion of the header through the opening of the support, the frictional resistance between the plurality of tubes and the refrigerant does not occur, and accordingly, the pressure drop of the refrigerant may be reduced.

Further, as the frictional resistance does not occur, noise may be reduced. Simultaneously, as the pressure drop is reduced, the heat exchange efficiency of the refrigerant may be improved.

Embodiments disclosed herein provide a heat exchanger in which a liquid refrigerant in a two-phase-state refrigerant flowing in the heat exchanger does not pass through tubes but rapidly flows to a lower end of a header. Embodiments also provide a heat exchanger in which, as a liquid refrigerant does not pass through tubes, only a gaseous refrigerant required to be condensed passes through the tubes.

Embodiments further provide a heat exchanger in which, as an amount of liquid refrigerant passing through tubes is reduced, noise caused by friction between the refrigerant and the tubes may be reduced. Embodiments additionally provide a heat exchanger in which, as a liquid refrigerant not required to be heat-exchanged does not pass through tubes, frictional resistance between the refrigerant and the tubes is decreased, thereby reducing pressure loss caused by the refrigerant inside of the heat exchanger. Embodiments also provide a heat exchanger in which, as the pressure loss of a refrigerant is reduced, the heat exchange efficiency of the heat exchanger is improved.

Embodiments disclosed herein provide a heat exchanger that may include a plurality of tubes in which a refrigerant may flow; a plurality of heat dissipation fins to which the plurality of tubes may be coupled, the plurality of heat dissipation fins allowing heat exchange between the refrigerant and a fluid to be performed therethrough; a header coupled to at least one side of the plurality of tubes, the header forming a flow space of the refrigerant; and a guide part or guide provided inside the header to guide flow of the refrigerant. The guide part may include a support part or support provided inside the header, the support part having an opening through which the refrigerant may pass; and a movable part provided to be movable at one side of the support part to selectively open the opening. As the movable part moves, a portion of the refrigerant does not pass through the plurality of tubes but may be moved to a lower portion of the header.

The heat exchanger according to embodiments configured as described above has at least the following advantages.

First, as a liquid refrigerant in a two-phase-state refrigerant flowing in the heat exchanger does not pass through the tubes but rapidly flows to a lower end of the header, only a gaseous refrigerant required to be condensed passes through the tubes. Second, as only the gaseous refrigerant passes through the tubes, frictional resistance between the refrigerant and the tubes according to a flow of the two-phase-state refrigerant may be decreased, and accordingly, frictional noise is reduced.

Third, as the frictional resistance between the refrigerant and the tubes is reduced, any pressure drop of the refrigerant does not occur, and accordingly, the heat exchange efficiency of the heat exchanger may be improved. Fourth, in the refrigerant passing through the tubes, an amount of liquid refrigerant not required to be heat-exchanged inside of the tubes is decreased, and simultaneously, an amount of gaseous refrigerant required to be heat-exchanged inside of the tubes is increased, thereby improving the heat exchange efficiency of the refrigerant.

Even though all the elements of the embodiments are coupled into one or operated in the combined state, embodiments are not limited to such an embodiment. That is, all the elements may be selectively combined with each other without departing the scope. Further, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope as defined by the appended claims. Therefore, the embodiments should be considered in descriptive sense only and not for purposes of limitation, and also the technical scope is not limited to the embodiments. Further, embodiments are defined not by the detailed description of the invention but by the appended claims, and all differences within the scope will be construed as being comprised in the present disclosure.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a plurality of tubes through which a refrigerant flows;

a plurality of heat dissipation fins to which the plurality of tubes is coupled, the plurality of heat dissipation fins allowing heat exchange between the refrigerant and a fluid;

at least one header coupled to the plurality of tubes, the at least one header forming a flow space for the refrigerant; and at least one guide provided inside of the at least one header to guide a flow of the refrigerant, wherein the at least one guide includes:

a support provided inside of the at least one header, the support having an opening through which the refrigerant in liquid form flowing into the at least one header flows; and a movable part that is located above the support where the movable part is configured to be floated by the refrigerant in liquid form such that the movable part opens or closes the opening.

2. The heat exchanger according to claim 1, wherein the at least one header extends in a first direction, wherein the plurality of tubes extends in a second direction, and wherein the plurality of tubes is coupled to the at least one header.

3. The heat exchanger according to claim 2, wherein the movable part is movable in a longitudinal direction of the at least one header.

4. The heat exchanger according to claim 1, wherein the movable part is made of a material having a density lower than a density of the liquid refrigerant.

5. The heat exchanger according to claim 1, wherein the support includes:

an inner circumferential surface that defines the opening; and an outer circumferential surface that contacts an inner surface of the at least one header.

6. The heat exchanger according to claim 5, wherein the opening is formed in a circular shape, and the movable part is formed in a spherical shape.

7. The heat exchanger according to claim 6, wherein a diameter of the movable part is greater than a diameter of the opening.

8. The heat exchanger according to claim 1, further including a plurality of baffles provided inside of the at least one header to partition the flow space of the refrigerant, wherein the at least one guide is provided between the plurality of baffles.

9. The heat exchanger according to claim 8, wherein the at least one header includes:

an inlet provided at an upper portion of the at least one header to allow the refrigerant to be introduced therethrough; and an outlet provided at a lower portion of the at least one header to allow the refrigerant to be discharged therethrough.

10. The heat exchanger according to claim 9, wherein the plurality of baffles includes:

a first baffle provided at an upper portion of the at least one header to guide the refrigerant introduced through the inlet to the plurality of tubes; and a second baffle provided at a lower portion of the at least one header to guide the refrigerant flowing in the plurality of tubes to the outlet.

11. The heat exchanger according to claim 9, wherein the at least one header includes a first header and a second header, and wherein a first end of the plurality of tubes is connected to the first header and a second end of the plurality of tubes is connected to the second header.

12. The heat exchanger according to claim 11, wherein the inlet is provided at an upper portion of the first header, and the outlet is provided at a lower portion of the first header.

13. The heat exchanger according to claim 1, wherein the plurality of tubes is spaced apart from each other by a predetermined distance in a longitudinal direction of the at least one header.

14. The heat exchanger according to claim 1, wherein each of the plurality of tubes includes a tube body that forms an external appearance thereof, and at least one partition rib that partitions a refrigerant flow path inside the tube body into a plurality of refrigerant flow paths.

15. The heat exchanger according to claim 14, wherein each of the plurality of heat dissipation fins includes a plurality of through holes, and wherein each of the plurality of tubes passes through the respective plurality of through holes and is coupled thereto.

16. A heat exchanger, comprising:

a plurality of tubes through which a refrigerant flows;

a plurality of heat dissipation fins to which the plurality of tubes is coupled, the plurality of heat dissipation fins allowing heat exchange between the refrigerant and a fluid;

at least one header coupled to the plurality of tubes, the at least one header forming a flow space for the refrigerant; and at least one guide provided inside of the at least one header to guide a flow of the refrigerant, wherein the at least one guide includes:

a support provided inside of the at least one header, the support having an opening through the refrigerant in liquid form flowing into the at least one header flows; and a ball or cylinder moveably that is located above the support where the ball or cylinder is configured to be floated by the refrigerant in liquid form such that the ball or cylinder opens or closes the opening.

17. The heat exchanger according to claim 16, wherein the ball or cylinder is made of a material having a density lower than a density of the liquid refrigerant.

* * * * *